United States Patent [19]

Büchler

[11] Patent Number: 4,824,085

[45] Date of Patent: Apr. 25, 1989

[54] DEVICE FOR HOLDING AND HANDLING A FLAT OBJECT

[75] Inventor: René Büchler, Oberbüren, Switzerland

[73] Assignee: Buchler B-Set AG, Flawil, Switzerland

[21] Appl. No.: 51,535

[22] Filed: May 18, 1987

[51] Int. Cl.[4] ..... B25B 1/22

[52] U.S. Cl. ..... 269/139; 269/266; 269/287; 269/221

[58] Field of Search ..... 269/139, 266, 287, 221–223, 269/218–220

[56] References Cited

U.S. PATENT DOCUMENTS

| | | | |
|---|---|---|---|
| 1,328,492 | 1/1920 | Carman | 269/139 |
| 2,518,867 | 8/1950 | Clary | 269/266 |
| 2,865,591 | 12/1958 | Holinshead | 269/287 |
| 4,412,676 | 11/1983 | Jackson | 269/139 |

FOREIGN PATENT DOCUMENTS

| | | | |
|---|---|---|---|
| 525321 | 1/1954 | Belgium | 269/266 |

*Primary Examiner*—Robert C. Watson
*Attorney, Agent, or Firm*—Helfgott & Karas

[57] ABSTRACT

A device for holding and handling a flat object, which can be a work piece to be machined or a tool for the same purpose, comprises a fixed clamp and a movable clamp which clamp the object therebetween. The device further includes a closed, rectangular, flat frame, whose one side is designed as the fixed clamp. The movable clamp can be introduced from outside into the frame and moved between the guides in the same. The movable clamp is provided with an arrangement for its fastening in the frame and is clampable against the flat object. On the side opposite to the fixed clamp of the frame there is provided at least one clamping device acting upon the movable clamp. The device allows clamping without a play and stack of the flat object. It is especially suited for precision machining in one or several successive machining operations, the pre-set machining position of the object being preserved during processing.

14 Claims, 2 Drawing Sheets

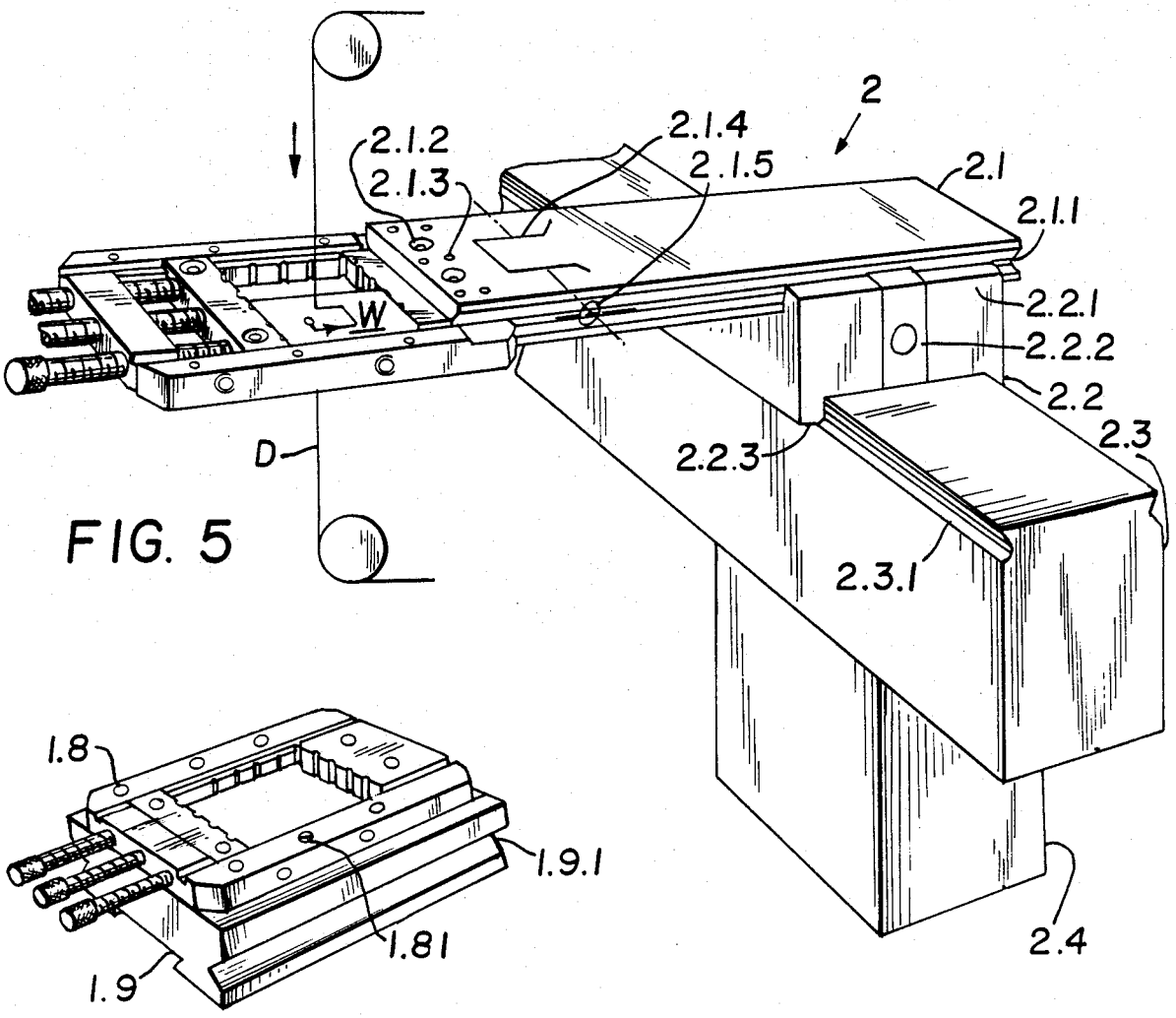
FIG. 5
FIG. 6
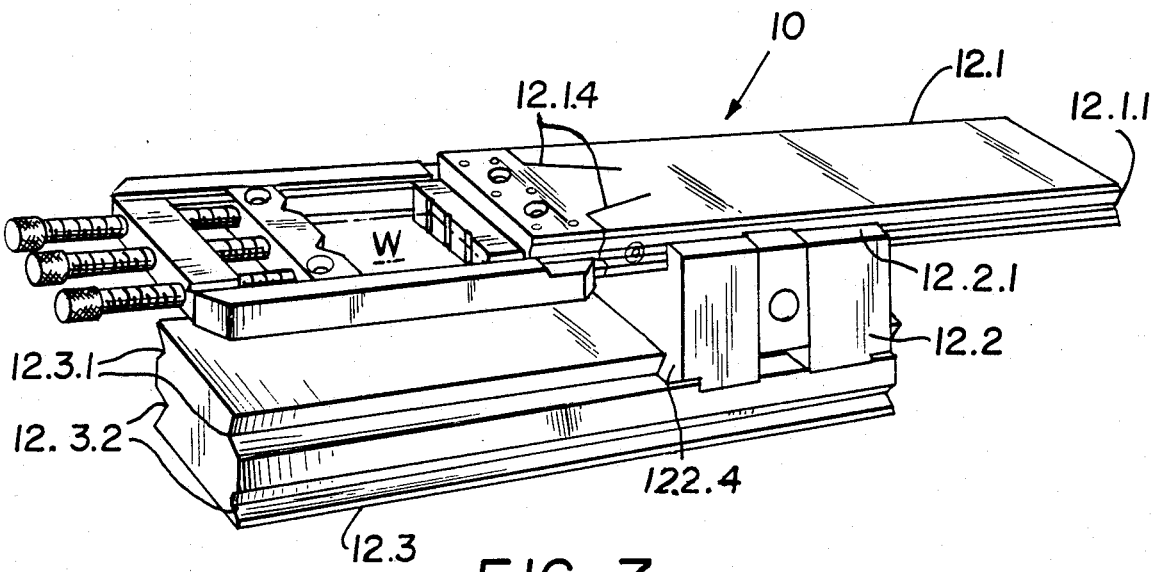
FIG. 7

DEVICE FOR HOLDING AND HANDLING A FLAT OBJECT

BACKGROUND OF THE INVENTION

The invention concerns a device for holding and handling a flat object, specifically for holding a flat work piece on a machine tool.

A prior art device has been disclosed, which is supposed to be also suitable for holding flat work pieces to be processed on a machine tool (Tech. Rundschau Jan. 86, Werkstatt, Zubehör für Drahterodiermaschinen [Accessory for Wire Erosion Machine]). It is designed as an adjustable wrench (so-called monkey wrench) and also has the characteristics of a vise. This device has the important disadvantage that it represents a system open on one side, and is therefore incapable of holding a work piece without play and slack. Since in certain production processes, such as, for example, electric spark erosion, a work piece position adjusted with high-precision and without stress must be preserved without play during processing, the use of the prior art device in such cases is of reduced utility.

SUMMARY OF THE INVENTION

Therefore, the objective of the invention is to improve the above-mentioned type of device so that it assures quick, stress-free and play-free clamping of flat objects for precision processing. In addition, the production operation should not be hindered by any parts of the device. Also, when the firmly held object is subjected to several processing steps on different machines, the pre-set processing position of the object must be assured, and automatic handling and/or transportation between the different processing machine should be possible.

The device of the invention, henceforward referred to as "Frame Clamp," makes it possible to hold with precision and without play or stress, a flat object in a rigid and closed system; therefore, it can be especially advantageously used in machining operations requiring extreme precision.

The flat object is attached in two steps:

Firstly the movable clamp is introduced into the frame; via the clamping means, it is carefully, yet positively brought into contact with the object to be attached, and firmly clamped;

then the movable clamp is firmly attached to the frame via the clamping means with an additional supporting fastener, which is equivalent to latching.

The device is of relatively simple construction, whose components, especially the movable clamp, are easily exchangeable. Thus, quick adaptation to objects of different types and contours can be achieved.

Another considerable advantage of the device of the invention is that it allows unhindered machining of the object clamped in the same to its outer contour, as well as, if required, full splitting of the same without the split parts changing their position.

The flat object in question can be a work piece to be machined or a tool. Thus the flat object can be an electrode in spark erosion fastened on an erosion machine clamped in the frame clamp.

Also, so-called "palleting" of high-precision fastened objects, specifically work pieces, can be achieved with the frame clamp. If one desires to perform a sequence of machining operations on different machines, maintaining the required work piece position in relation to a reference point on a presetting station, the frame clamp and work piece can be simply fastened on the different machines without altering the relative position of the work piece in relation to the reference system. Thus high reproducibility of a definite machining position of a work piece is obtained at the beginning of each operation.

Simple and quick insertion of the movable clamp into the frame and, at the same time, a positive contact between this clamp and the object to be clamped can be achieved. The frame clamp can be adapted to the contour of different objects to be held.

The smallest possible, and therefore clean contact surfaces are obtained between the object and the frame clamp when the flat object is clamped, so that the machining chips and dirt can be removed and, in the case of wire erosion processing, the wire electrode can threaded up without a start hole.

The clamping process is facilitated, specifically in view of semi- or fully automatic clamping in the device according to the invention.

The possibility for automatic handling of the frame clamp and for the combination of the same with further handling devices, is obtained in the device according to the present invention.

The invention is explained in more detail below with the help of the examples of embodiment and with reference to the drawings.

BRIEF DESCRIPTION OF THE DRAWING

FIG. 5 shows a first example of application of the device of the invention in a handling system for precision machining of flat work pieces;

FIG. 6 shows a second example of application of the device; and

FIG. 7 shows a third example of application of the device.

DETAILED DESCRIPTION OF THE PREFERRED EMBODIMENT

Figure 1:
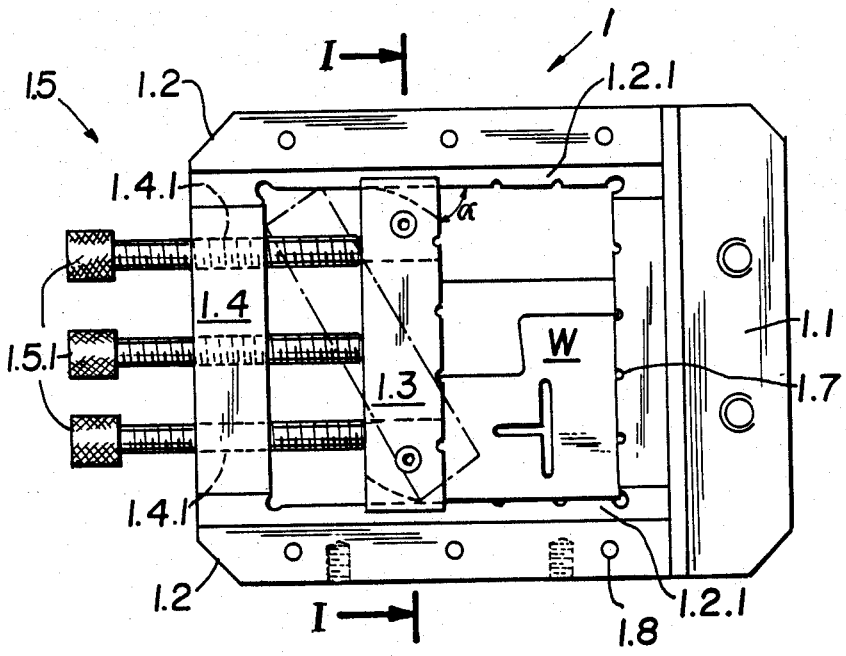
FIG. 1 is a top view of the device of the invention.

The device represented in FIG. 1 has a closed, rectangular, flat frame 1, whose one (right-hand in FIG. 1) transversal side is designed as a fixed clamp 1.1. Furthermore, the device has a movable clamp 1.3, which is insertable into the frame from the outside and is guided along the longitudinal side 1.2 of said frame. Clamp 1.3 can be fastened to the longitudinal side 1.2 of frame 1 and it can be clamped against a flat object W to be held (see also FIGS. 2 through 4). Transversal side (left-hand on FIG. 1) 1.4 of frame 1 has a clamping means 1.5 acting upon movable clamp 1.3, which clamping means consists, in this particular example of embodiment, of three threaded bolts 1.5.1 inserted into holes 1.4.1 tapped into the left-hand transversal side 1.4. According to one version (not illustrated) of the invention, also hydraulic or pneumatic pressure mechanisms can be used as clamping means 1.5.

Rigid frame 1 and the precise guiding, described in detail below, of movable clamp 1.3 allow accurate clamping, without play or slack, of the flat object W to be held.

Figure 2:
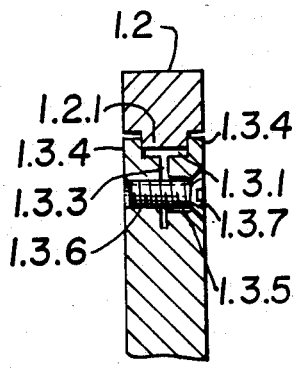
FIG. 2 is a partial break-away section along line I-I of FIG. 1.
Figure 3:
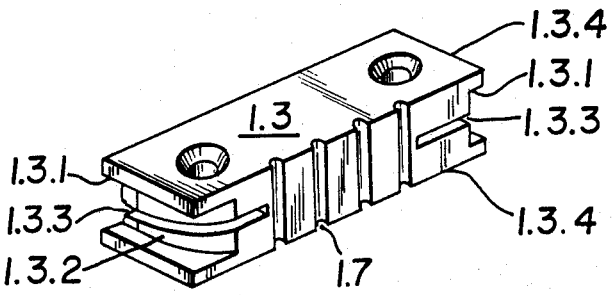
FIG. 3 is a perspective view of the movable clamp used in the invention.

As can be seen specifically in FIGS. 2 and 3, movable clamp 1.3 has basically the shape of a parallelipiped, provided with a groove 1.3.1 on each of its two smaller lateral surfaces. The top view of movable clamp 1.3 shows arc-shaped groove bottom 1.3.2 (see broken lines in FIGS. 1 and 4). Arc-shaped bottom 1.3.2 of the two facing grooves is designed so that one groove (upper groove in FIG. 1) has a deep cut, decreasing rearwards in the direction of the clamping means side, while the bottom of the other groove (lower groove in FIG. 1) has, seen from the work piece side, a small cut depth, which increases rearwards in the direction to the clamping means side. In other words, the groove bottom in the diagonally opposite corners of the movable clamp is cut deeper, and in the other diagonally opposite corners it is cut shallower. The deeper cut is located in the corner which, when movable clamp 1.3 is introduced into frame 1 (see clamp position shown by a broken line in FIG. 1) is closer to guide bead 1.2.1 (see also FIGS. 4 through 6). As shown in FIG. 1 by the broken-dotted line, the insertion of movable clamp 1.3 into the frame starts in an oblique position, it being advantageous that the corners of movable clamp 1.3 be rounded or beveled.

Each of the two grooved ends of movable clamp 1.3 is split into two times 1.3.4 by a slot 1.3.3 (FIG. 3). Slots 1.3.3 extend from the center line of each groove bottom 1.3.2 parallel to the largest lateral face of movable clamp 1.3 to the center thereof. They also run approximately in the center plane of frame 1. Tines 1.3.4 of each pair on both sides of Clamp 1.3 can elastically move somewhat in relation to each other due to slot 1.3.3 that separates them, and thus can be attached to guide bead 1.2.1 of the respective longitudinal side 1.2 of the frame. Each pair of tines 1.3.4 has a hole with a common axis perpendicular to the slot surface. Hole 1.3.5 in one tine is a through hole with smooth walls. The other, coaxial, hole 1.3.6 in the other tine 1.3.4 is a tapped hole. Thus pairs of tines 1.3.4, embracing guide bead 1.2.1 on the inside of the facing longitudinal frame side 1.2 can be pressed with the help of a countersunk screw 1.3.7 against guide bead 1.2.1 and positively attached thereto (see specifically FIG. 2).

Instead of holes 1.3.5, 1.3.6 and countersunk screws 1.3.7, the pairs of tines 1.3.4 can also be clamped to the respective guide bead 1.2.1 with the help of a hydraulic or pneumatic pressure mechanism.

If the flat object W has straight, but not parallel lateral surfaces, movable clamp 1.3 can also be designed with a pressure side, which is inclined at an angle in relation to longitudinal frame side 1.2.

Figure 4:
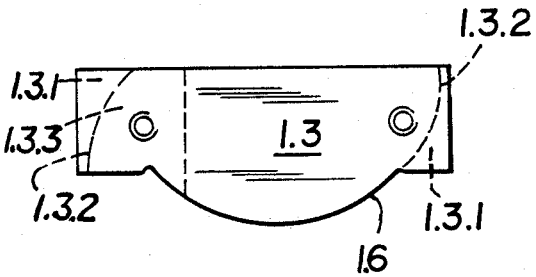
FIG. 4 is a top view of a movable clamp of a variant of the invention, wherein part of a corner is cut away.

To match the irregular or curved contour of a flat object W, the surfaces of clamps 1.1 and 1.3, as well as those of longitudinal frame sides 1.2, in contact with the lateral surfaces of object W can be designed as special profiles 1.6, as shown in FIG. 4 for a simple example with circular contour.

FIG. 1 shows furthermore that the surfaces of fixed clamp 1.1, movable clamp 1.3, as well as guide beads, 1.2.1 facing work piece W, have grooves 1.7 cut into them, with a semicircular cross section and running perpendicularly to the frame surface. The grooves can also have another shape, for example, a triangular cross section. The effective contact surfaces are reduced by these grooves 1.7. Thus, these contact surfaces can be kept cleaner, specifically by removing waste material, dirt, such as metallic chips, etc.

Furthermore, in case of processing by wire erosion, the wire electrodes can be threaded up in these grooves.

FIG. 2 shows even more clearly that the width of grooves 1.3.1 matches the width of guide beads 1.2.1, so that when countersunk screw 1.3.7 is not fully tightened, the movable clamp can be slightly moved in relation to the frame; however, it is firmly clamped to guide beads 1.2.1 when countersunk screw 1.3.7 is tightened.

FIG. 5 shows a first example of embodiment of the device of the invention for the purpose of automatic handling of a firmly clamped flat object W, which is processed by wire electrode D of a wire electrode machine (not shown) in a handling system 2 with a flat carriage 2.1 movable along the X and Y axes. FIG. 5 shows one of two grooves 2.1.1 cut on both longitudinal sides of flat carriage 2.1. Groove 2.1.1 has a trapeze-shaped cross section. On the other hand, the other groove, not shown in FIG. 5, has a triangular cross section. Both edge surfaces of the adjacent sides of the carriage next to grooves 2.1.1 are machined as finely and precisely machined guide surfaces, while front groove 2.1.1 has a less precisely dimensioned cut surface.

Flat Carriage 2.1 is guided with the help of grooves 2.1.1 along the guide edges of a movable support 2.2, of which only one 2.2.1 is shown in FIG. 5. Guide edge 2.2.1 engaging into front groove 2.1.1 is provided with a stop device 2.2.2 for positioning carriage 2.1. Support 2.2 is in turn movable, with the help of guide edge 2.3, at a right angle to the direction of movement of flat carriage 2.1, these guide edges 2.2.3 being guided along the path determined by grooves 2.3.1 of a girder 2.3. Girder 2.3 facing flat carriage 2.1 is movable on a stand 2.4. Flat carriage 2.1 is connected to fixed clamp 1.1 of the frame clamp with the help of fastening Screws 2.1.2 and adjusting Screws 2.1.3, according to FIG. 1. With the help of adjusting screws 2.1.3, the frame clamp and flat carriage 2.1 can be precision-adjusted in a horizontal plane by very small partial oscillating movements of material areas near each adjusting screw 2.1.3 approximately around the axes parallel to grooves 2.1.1 of flat carriage 2.1.

A further possibility for fine adjustment of flat carriage 2.1 regarding its unhindered movability and precise guiding between guide edges 2.2.1 of movable support 2.2 is given by a basically U-shaped slot 2.1.4, which runs adjacent to the area of fastening and adjustment screws 2.1.2 and 2.1.3 in flat carriage 2.1. At a right angle to either side of U-shaped slot 2.1.4 is a tapped hole, not shown in FIG. 5, in flat carriage 2.1, starting from either side of the U-shaped slot 2.1.4 and ending in groove 2.1.1 on the respective adjacent longitudinal side of flat carriage 2.1. Then, with the help of a threaded pin 2.1.5 inserted in the tapped hole, whose inside end always presses against the corresponding side of the material area limited by U-shaped slot 2.1.4 of flat carriage 2.1, the fine adjustment of grooves 2.1.1 of the same can be completed on guide edges 2.2.1 of the movable support by slight partial rotating movement around a vertical axis. The frame clamp illustrated in FIG. 5 is identical to that of FIGS. 1 through 3.

FIG. 6 shows a frame clamp of a similar design. It is mounted, with the help of holes 1.8 drilled in frame 1, as well as of screws 1.8.1 inserted in said holes, onto plate 1.9. Plate 1.9 has grooves 1.9.1 for handling, which are similar to grooves 2.1.1 of flat carriage 2.1 of FIG. 5.

FIG. 7 shows the use of a frame clamp according to FIGS. 1 through 3 in another handling system 10, for machining object W clamped in the frame clamp on both sides, regardless of whether this object is flat or whether it extends beyond the frame clamp on both sides. The handling system is based on the arrangement of FIG. 5. The frame clamp is preferably mounted on a flat carriage 12.1, and this in turn is movably placed with lateral grooves 12.1.1 between guide edges 12.2.1 on the upper longitudinal sides of a movable support 12.2. Two slots 12.1.4 are cut on flat carriage 12.1, which run approximately from the center area of flat carriage 12.1 obliquely and over a bend to the respective groove 12.1.1.

Support 12.2 is guided with the help of further guide edges 12.2.4 of the same type, located on its lower longitudinal edges, in a pair of grooves 12.3.1, running along the upper longitudinal edges of a girder 12.3 positioned parallel to the movement of flat carriage 12.1, and designed to have a play according to their cross section areas and surface characteristics in relation to grooves 12.1.1 of flat carriage 12.1.

Girder 12.3 serving for parallel guiding of support 12.2 is also provided with a pair of grooves 12.3.2 cut into its lower longitudinal edges, which correspond, regarding their cross section area and surface characteristics, to those 12.1.1 of flat carriage 12.1.

To allow object W to be machined from the underside of the frame clamp, invisible in FIG. 7, said clamp, together with flat carriage 12.1 and Support 12.2 can be mounted on the underside of girder 12.3 which serves for parallel guiding, while lower guide edges 12.2.4 of support 12.2 are introduced into the lower grooves 12.3.2 of girder 12.3, so that flat carriage 12.1 and the frame clamp with object W to be machined face downwards in a position rotated 180° around the longitudinal axis of the girder.

Other embodiments and modes of application of the device of the invention are conceivable. Thus, flat carriage 2.1 in the arrangement of FIG. 5 can be replaced by a round cylindrical shaft guidable in a housing and limited in its axial and rotation motion. It is also possible to replace the simple clamp in the same arrangement of FIG. 5 by a multiple clamp, the direction of movement and clamping of the respective movable clamps being perpendicular to the direction of travel of the respective carrier (flat carriage, cylindrical shaft, etc.). Flat carriage 12.1 of the arrangement of FIGS. 7 and 5 can also have a design similar to that of girder 12.3 serving for parallel guiding with a cross section similar to that of girder 12.3, possibly with four grooves such as those of the girder. Such a carriage could then be introduced also in a position rotated 180° around its longitudinal axis between guide edges 12.2.1 of support 12.2.

I claim:

1. Device for holding and handling a flat object, specifically for holding a flat work piece on a machine tool, comprising:

a fixed clamp and a movable clamp wherein the object can be clamped between said fixed clamp and said movable clamp;

a closed, rectangular, flat frame, one side of which serves as the fixed clamp, said movable clamp being insertable into said frame from the outside thereof and being guided in said frame and attachable to the flat object;

clamping means for clamping said movable clamp to said frame; and at least one fastening means acting upon the movable clamp arranged on a side of said frame opposite to the fixed clamp, said movable clamp being substantially in the shape of a square parallelipiped and having a groove in each of two front sides thereof opposite each other, and said frame having a guide bead arranged on each of two inner surfaces, facing each other, of longitudinal sides of the frame, each guide bead engaging in a respective groove.

2. Device according to claim 1, wherein each said grooves, a viewed from a top in a direction of said movable clamp, has an arc-shaped bottom, one groove having a continuously increasing depth and another groove having a continuously decreasing depth in a direction from a front side facing the object to a rear side facing said fastening means.

3. Device according to claim 1, wherein said movable clamp is split, on each of sides thereof guided on said frame by a slot extending parallel to the largest lateral faces of said movable clamp relative to a center thereof, into two tines, each slot starting on a bottom of the groove so that said tines are firmly attachable by said clamping means to said frame.

4. Device according to claim 3, wherein said tines are grouped in pairs and each slot is provided with a hole normal to a slot surface, the hole being a tapped hole in one of each pair of said tines grouped in pairs, said clamping means including a screw which can be inserted in said tapped hole and which presses both tines of each pair against said guide bead engaging in the respective groove.

5. Device according to claim 1, wherein each clamp has lateral surfaces facing the object to be clamped, said lateral surfaces and the surfaces of the longitudinal sides of said frame facing the object having a special profile matching a contour of the object.

6. Device according to claim 1, wherein sides of each clamp facing the object and the longitudinal sides of said frame, have further grooves extending perpendicular to the plane of the frame.

7. Device according to claim 6, wherein said further grooves have a semicircular cross-section.

8. Device according to claim 1, wherein said fastening means are threaded bolts, arranged in tapped holes formed in a side of the frame opposite to said fixed clamp.

9. Device according to claim 1, wherein said clamping means and said fastening means are each a hydraulic pressure mechanism.

10. Device according to claim 1, wherein said clamping means and said fastening means are each a pneumatic pressure mechanism.

11. Use of the device according to claim 1, for holding and handling a flat object during a series of successive machining operations.

12. Use of the device according to claim 11, wherein the device is fastened to a plate by means of holes arranged in said frame and screws inserted in said holes.

13. Use of the device according to claim 11, wherein the device is fastened to a plate by means of a handling device including at least one flat carriage guidable on a support by shaped grooves, and is conveyed between different machine tools.

14. Use of the device according to claim 11, wherein the device is fastened to a plate by a handling device including a shaft guidable in a cylindrical housing attached to said fixed clamp by fastening screws and adjusting screws, said device being conveyed between different machine tools.

* * * * *